US011401149B1

(12) United States Patent
Bennett

(10) Patent No.: US 11,401,149 B1
(45) Date of Patent: Aug. 2, 2022

(54) FUNNEL ASSEMBLY

(71) Applicant: HOPKINS MANUFACTURING CORPORATION, Emporia, KS (US)

(72) Inventor: Kyle M. Bennett, Emporia, KS (US)

(73) Assignee: HOPKINS MANUFACTURING CORPORATION, Emporia, KS (US)

( * ) Notice: Subject to any disclaimer, the term of this patent is extended or adjusted under 35 U.S.C. 154(b) by 0 days.

(21) Appl. No.: 17/380,283

(22) Filed: Jul. 20, 2021

(51) Int. Cl.
*B67C 11/02* (2006.01)
*B67C 11/04* (2006.01)

(52) U.S. Cl.
CPC ..... *B67C 11/02* (2013.01); *B67C 11/04* (2013.01)

(58) Field of Classification Search
CPC ..... B67C 11/02; B67C 11/04
USPC ..... 141/331–345; 220/735; 15/323
See application file for complete search history.

(56) References Cited

U.S. PATENT DOCUMENTS 423,954 A * 3/1890 Richardson ..... B67C 11/02 141/331
1,660,442 A * 2/1928 Hampton ..... B67C 11/02 137/147
2,179,400 A * 11/1939 Casner ..... B67C 11/02 141/334
2,858,050 A * 10/1958 Barnard ..... B67B 7/28 222/88
3,986,538 A * 10/1976 Sather ..... B67C 11/02 141/332
4,130,147 A * 12/1978 Langlie ..... B67C 11/02 141/333
4,600,125 A * 7/1986 Maynard, Jr. ..... B67B 7/28 141/330
5,150,811 A * 9/1992 Kelston ..... A47G 23/0258 206/217
5,228,488 A * 7/1993 Fletcher ..... B67C 11/04 141/331
5,303,447 A * 4/1994 McKnight ..... A47L 9/0036 15/246.2
5,967,201 A * 10/1999 Gasior ..... B67C 11/04 141/106
6,098,678 A * 8/2000 Shears ..... B67C 11/02 141/331
6,340,038 B1 * 1/2002 Ingram ..... B67C 11/02 141/333
D517,913 S * 3/2006 Mouyos ..... D9/434
8,464,896 B2 * 6/2013 Beary ..... A47G 19/2222 220/708
8,622,100 B2 * 1/2014 Levy ..... B67C 11/02 141/87

(Continued)

*Primary Examiner* — Timothy L Maust
(74) *Attorney, Agent, or Firm* — Hovey Williams LLP

(57) ABSTRACT

A funnel assembly comprising a funnel, a fill tube, a valve, and tube storage structure. The funnel includes an outer wall defining a fill chamber and including alignment structure. The tube storage structure includes an upper holder positioned near the upper opening and left and right guides spaced below the upper holder. The alignment structure is configured to align with and accept a stored tube of another funnel assembly when the funnel assemblies are stacked together. The fill tube is configured to be fluidly connected to the funnel. The tube storage structure is configured to removably secure the fill tube to the funnel when the upper end of the fill tube is not fluidly connected to the funnel so that the fill tube substantially conforms to the convex, tapered outer wall.

11 Claims, 5 Drawing Sheets

(56) References Cited

U.S. PATENT DOCUMENTS

| | | | | |
|---|---|---|---|---|
| 8,631,841 | B1 * | 1/2014 | Levy | B67C 11/02 141/342 |
| 10,539,319 | B2 * | 1/2020 | Dunphy | B67C 11/04 |

* cited by examiner

FUNNEL ASSEMBLY

BACKGROUND

Funnels often come with flexible fill tubes for filling relatively inaccessible tanks and containers. The fill tubes are often folded over while still attached to the funnels during shipping, which kinks the fill tubes. The kinks hinder liquid flow, so users tend to cut off the kinked portion of the fill tubes and reattach the unaffected portion of the fill tubes to the funnels. These modifications result in shorter-than-desired fill tubes and leaks.

SUMMARY

Embodiments of the present invention solve the above-mentioned problems and other related problems and provide a distinct advance in the art of funnel assemblies. More particularly, the present invention provides a funnel assembly that facilitates unitary and compact storage and transport without kinking its fill tube.

An embodiment of the invention is a funnel assembly that can be dissembled into a stored configuration. The funnel assembly broadly comprises a funnel, a fill tube configured to be detachably stored with the funnel, a valve, and tube storage structure.

The funnel includes an outer wall defining a fill chamber, an upper opening, and a hanging aperture. The outer wall also includes valve connection structure, alignment structure, and grip recesses. The valve connection structure is positioned near a bottom of the funnel and is configured to secure the valve to the funnel.

The alignment structure is configured to align with and accept a stored fill tube of another funnel assembly so that the funnel assemblies can be aligned with each other and nestably stacked together. In one embodiment, the alignment structure is positioned near the upper opening. The grip recesses include grip protrusions, grip material, or the like. The grip recesses allow a user to grasp the funnel with a thumb and forefingers.

The fill tube is a flexible conduit including opposing upper and lower ends and an end cap. The upper end is configured to be fluidly connected to the funnel via a lower opening (of the funnel and/or valve) in a fill configuration and to the tube storage structure in the stored configuration.

The valve is positioned below the funnel and may include structure for temporarily closing off the fill chamber from the lower opening. The valve may be separate from the outer wall or may be integrated therewith.

The tube storage structure is positioned on an outside of the outer wall and includes an upper holder and opposing left and right guides. The tube storage structure secures the fill tube to the outer wall when the fill tube is not fluidly connected to the funnel via the lower opening.

The upper holder is a male boss or similar protrusion configured to be inserted into an end of the fill tube to secure the fill tube in a stored configuration. To that end, the upper holder faces downward and extend substantially parallel to the outer wall and may form an interference fit with the end of the fill tube.

The opposing left and right guides are positioned below the upper holder and are configured to cradle the fill tube in the stored configuration. To that end, the left and right guides align the fill tube substantially parallel with the outer wall so that the fill tube substantially conforms to the shape of the outer wall. The left and right guides are also vertically offset from each other to ease insertion and removal of the fill tube.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
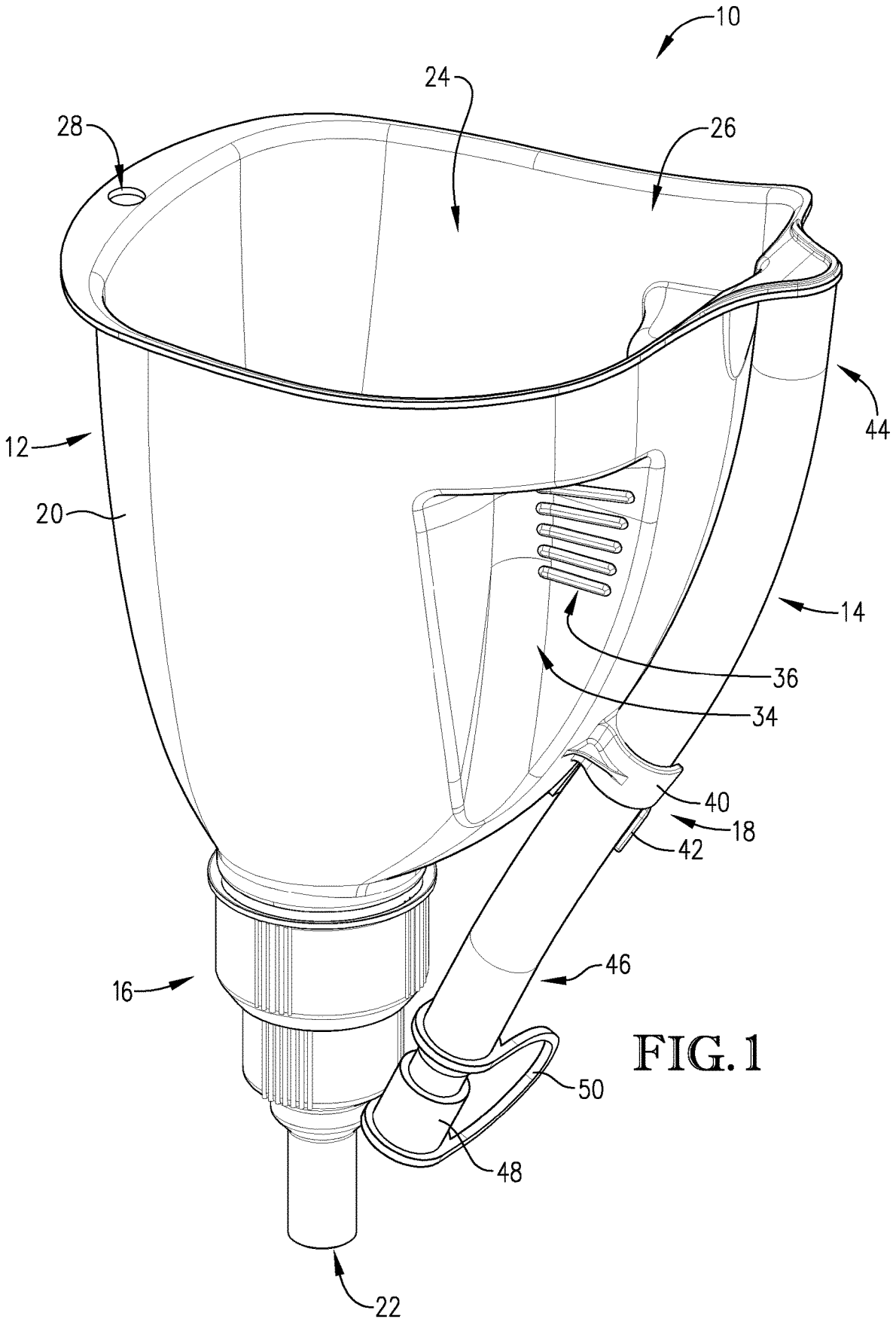
FIG. 1 is a perspective view of a funnel assembly constructed in accordance with an embodiment of the invention.
Figure 2:
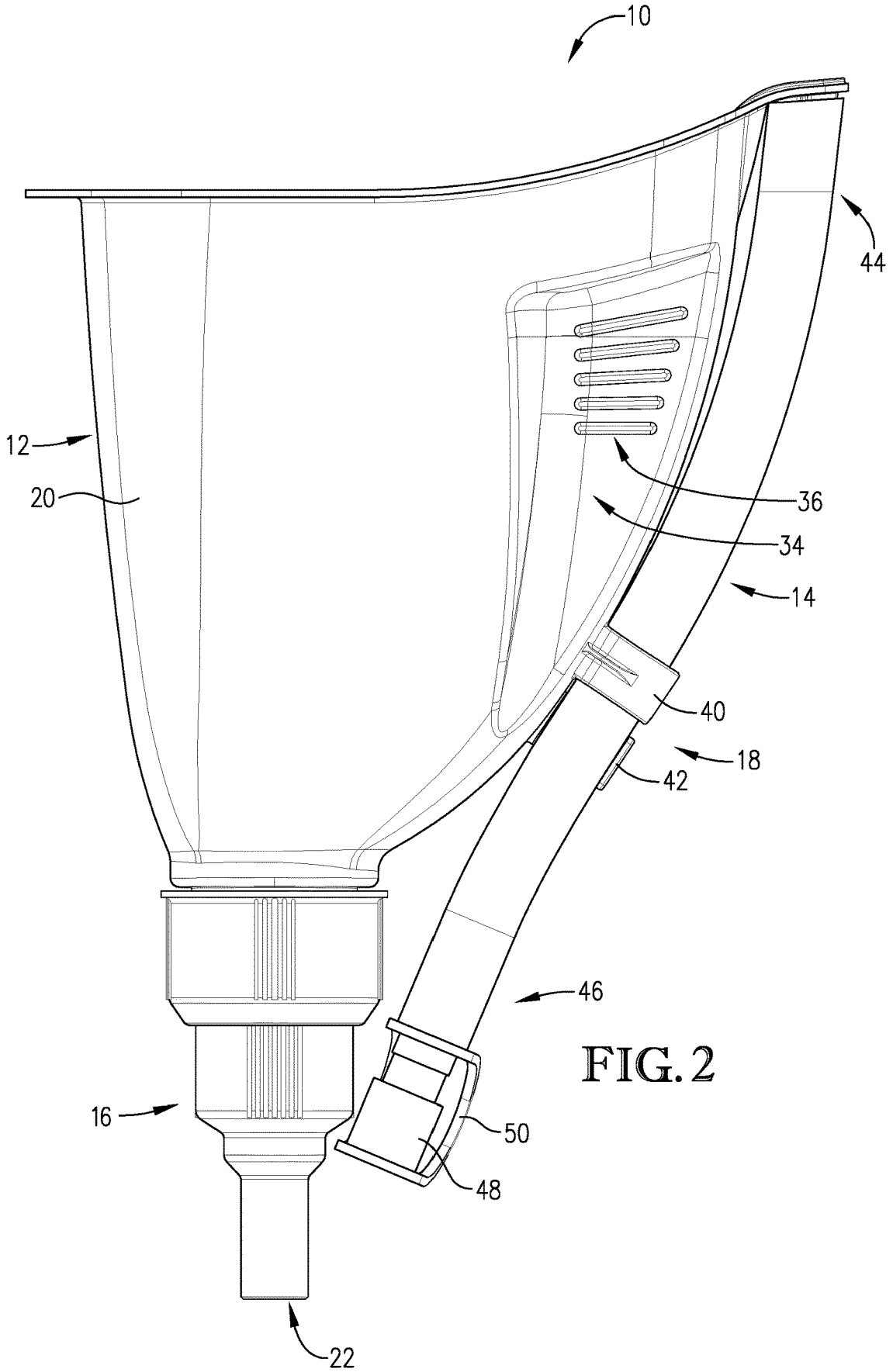
FIG. 2 is a side elevation view of the funnel assembly of FIG. 1.
Figure 3:
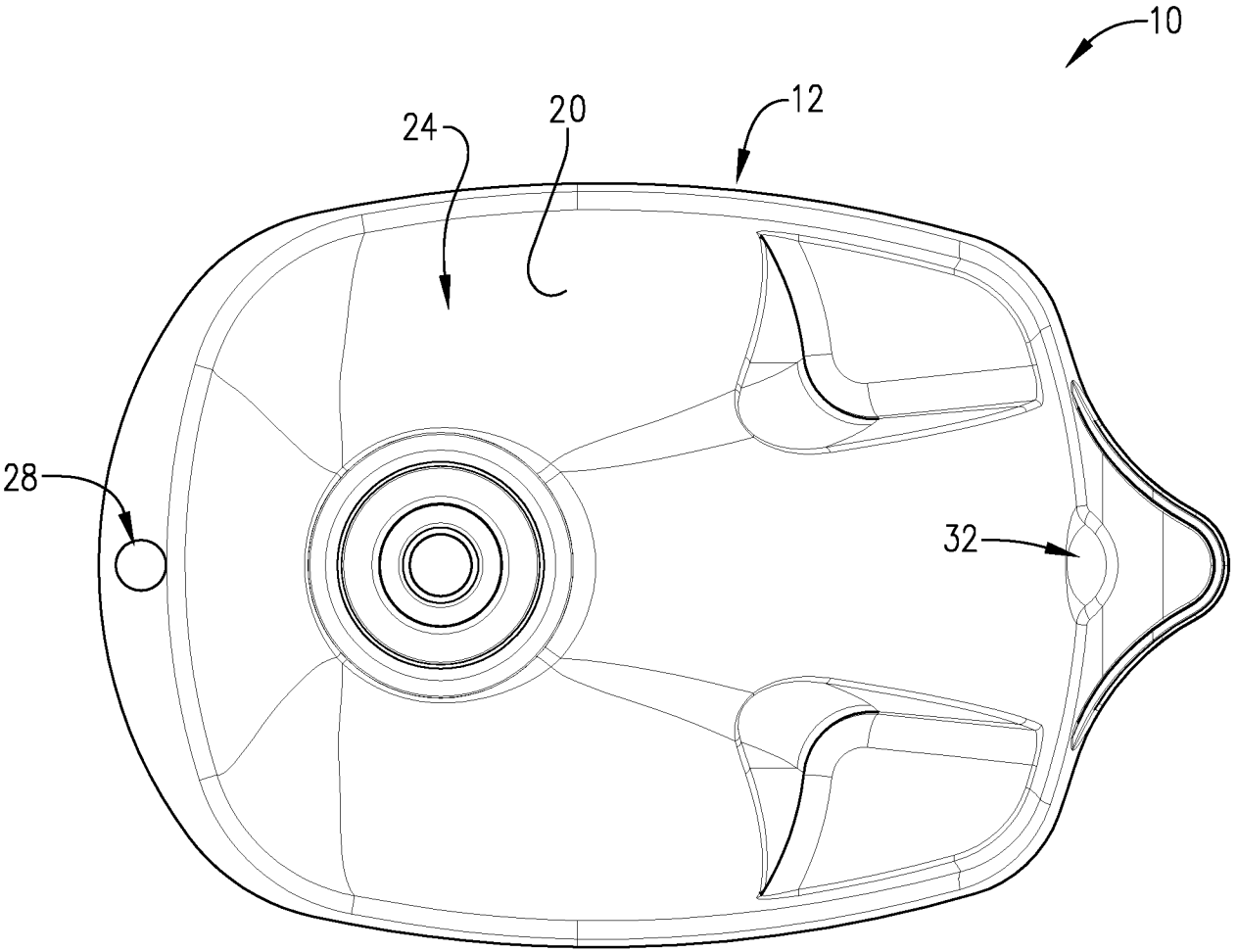
FIG. 3 is a top view of the funnel assembly of FIG. 1.
Figure 4:
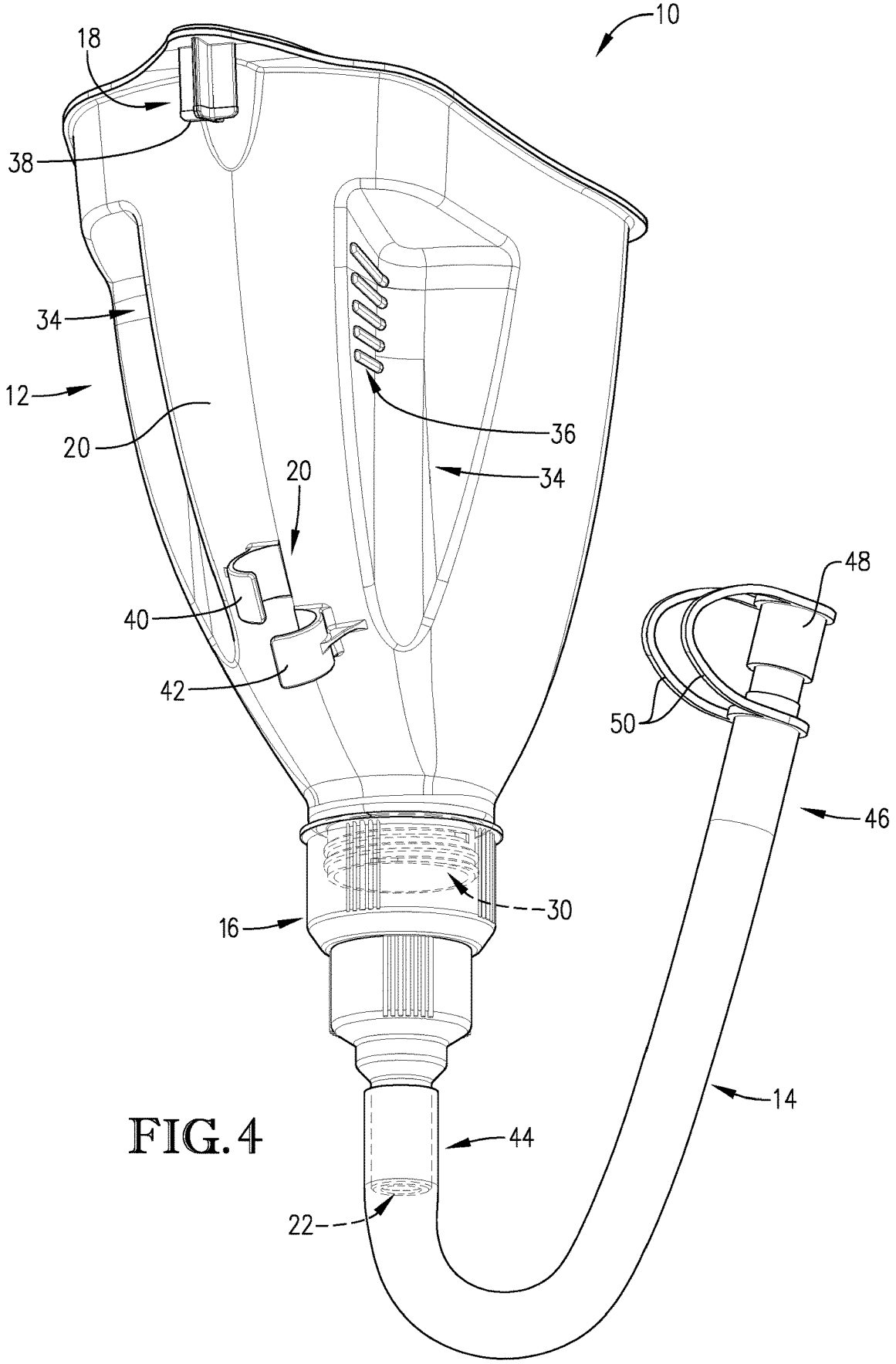
FIG. 4 is a bottom perspective view of the funnel assembly of FIG. 1.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE EMBODIMENTS

Turning to the drawing figures, a funnel assembly 10 constructed in accordance with an embodiment of the invention is illustrated. The funnel assembly 10 broadly comprises a funnel 12, a fill tube 14, a valve 16, and tube storage structure 18.

The funnel 12 includes an outer wall 20 and is fluidly connectable to the fill tube 14 via lower opening 22. To that point, the funnel 12 is shown as indirectly connectable to the fill tube 14 by the valve 16, but in some embodiments the funnel 12 can be connected directly to the fill tube 14.

The outer wall 20 defines a fill chamber 24, an upper opening 26, and a hanging aperture 28. The outer wall 20 also includes valve connection structure 30, alignment structure 32 and grip recesses 34. The outer wall 20 may also include fill marks to indicate liquid volume levels. The outer wall 20 may be partially transparent to view the liquid against the liquid volume levels. The outer wall 20 may be tapered from the upper opening 26 to the valve connection structure 30 and may be substantially convex.

The fill chamber 24 receives oil, coolant, water, or any other desired liquid via the upper opening 26. The fill chamber 24 may hold a maximum pre-determined amount of liquid such as thirty-two ounces, forty ounces, or any other suitable amount.

The hanging aperture 28 is positioned near the upper opening and is configured to receive a storage hook therethrough. In this way, the funnel assembly 10 can be stored on a pegboard wall or other similar location when not in use.

The valve connection structure 30 is positioned near a bottom of the funnel 12 and is configured to secure the valve 16 to the funnel 12. The valve connection structure 30 may include helical threads, fasteners, interlocking geometry, or the like. In another embodiment, the valve 16 is integral with the outer wall 20 and thus valve connection structure is not needed.

The alignment structure 32 may be an indentation, recess, groove, or other similar feature configured to align with and accept a stored fill tube of another funnel assembly so that the funnel assemblies can be aligned with each other and nestably stacked together. In one embodiment, the alignment structure 32 is positioned near the upper opening 26.

The grip recesses 34 include grip protrusions 36, grip material, or the like. The grip recesses 34 allow a user to grasp the funnel 12 with a thumb and forefingers.

The valve 16 is fluidly connected to the funnel 12 and may include structure for temporarily closing off the lower opening 22. For example, the valve 16 may include a rotatable disc including an opening configured to be aligned with an opening of a stationary structure. The valve 16 is thereby open when the openings are at least partially aligned and closed when the openings are not even partially aligned. Alternatively, the valve 16 may include a seal or mating structure configured to be extended to expose a liquid pathway. The valve 16 may be separate from the outer wall 20 or may be integrated therewith.

The tube storage structure 18 is positioned on an outside of the outer wall 20 and includes an upper holder 38, and opposing left and right guides 40, 42. The tube storage structure 18 secures the fill tube 14 to the outer wall 20 when the fill tube 14 is not connected to the funnel 12 via the lower opening 22.

The upper holder 38 may be a male boss or similar protrusion configured to be inserted into an end of the fill tube 14 to secure the fill tube 14 in a stored configuration. To that end, the upper holder 38 may face downward and extend substantially parallel to the outer wall 20 and may form an interference fit with the end of the fill tube 14.

The opposing left and right guides 40, 42 are positioned below the upper holder 38 and are configured to cradle the fill tube 14 in the stored configuration. To that end, the left and right guides 40, 42 may align the fill tube 14 substantially parallel with the outer wall 20 so that the fill tube 14 substantially conforms to the shape of the outer wall 20. In one embodiment, the left and right guides 40, 42 are vertically offset from each other to ease insertion and removal of the fill tube 14.

The fill tube 14 is a flexible conduit including opposing upper and lower ends 44, 46 and an end cap 48. The upper end 44 is configured to be connected to the funnel 12 at the lower opening 22 in a fill configuration and to the tube storage structure 18 in the stored configuration.

The end cap 48 is configured to be positioned over the lower end 46 and may include a connector 50 for retaining the end cap 48 with the remainder of the fill tube 14 when the end cap 48 is not attached to the lower end 46.

For transportation and storage, the fill tube 14 may be inserted between the left and right guides 40, 42 with the upper end 44 of the fill tube 14 being inserted onto the upper holder 38 so that the fill tube 14 is in a stored configuration. The tube storage structure 18 (left and right guides 40, 42 and upper holder 38) substantially conform the fill tube 14 to the shape of the outer wall 20.

Figure 5:
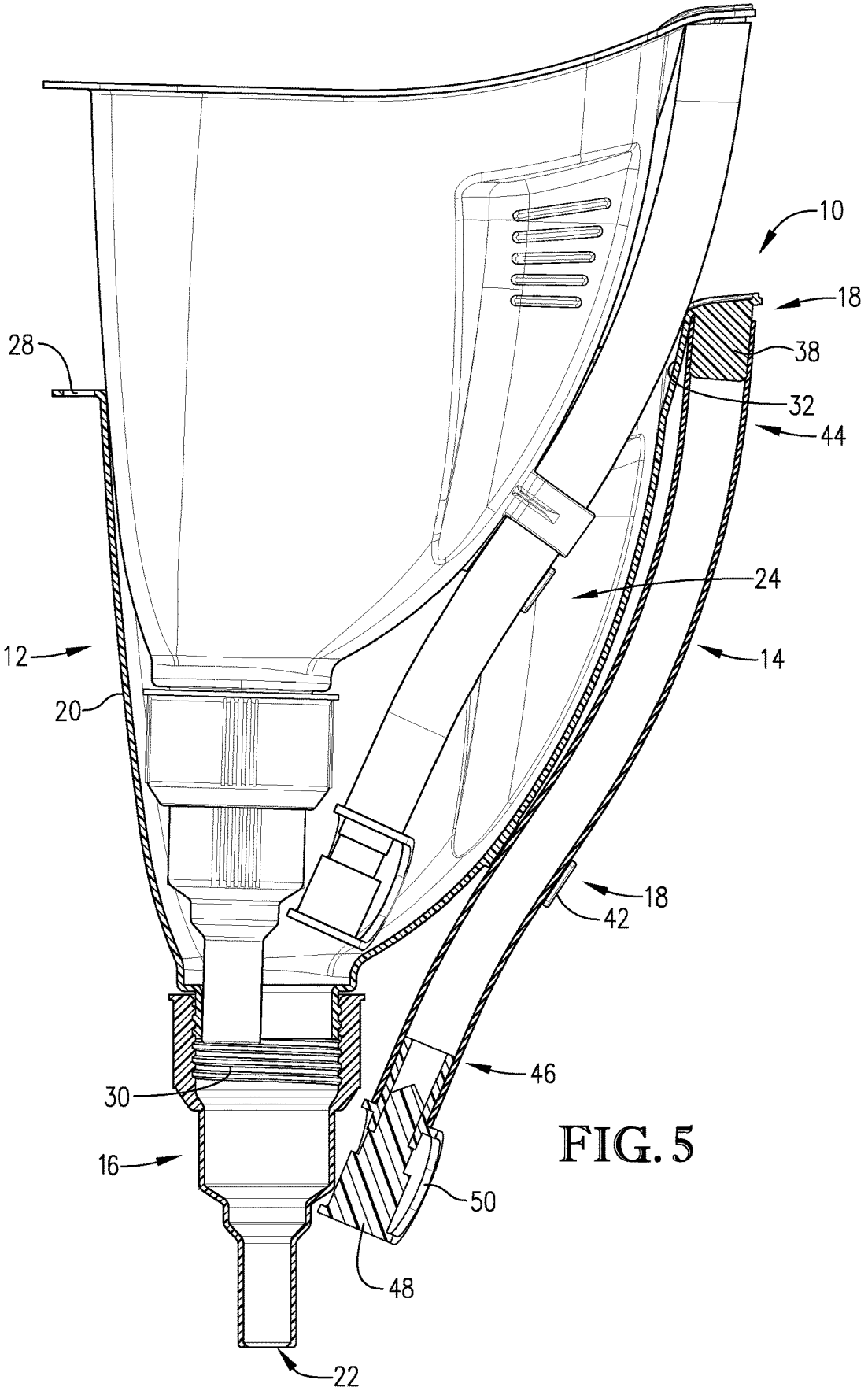
FIG. 5 is a side cutaway elevation view of nestably stacked funnel assemblies including the funnel assembly of FIG. 1.

The funnel assembly 10 may also be nestably stacked with other funnel assemblies for transportation, sale, and storage, as shown in FIG. 5. To that end, another funnel assembly may then be inserted into the fill chamber 24 of the funnel assembly 10 with the fill tube of the inserted funnel assembly aligning with and being received in the alignment structure 32 of the funnel 12. Similarly, the fill tube 14 may in turn be inserted into a fill chamber of yet another funnel assembly and aligned with its alignment structure. This ensures organized and consistent stacking between funnel assemblies.

The funnel assembly 10 may then be removed from the stack for individual sale or use. The fill tube 14 may then be removed from the tube storage structure 18. Specifically, the upper end 44 of the fill tube 14 may be pulled downward off the upper holder 38, and the fill tube 14 may be pivoted slightly and then axially from the left and right guides 40, 42. The upper end 44 of the fill tube 14 may then be fluidly connected to the funnel 12 via the lower opening 22.

With the valve 16 closed, the funnel 12 may be grasped by one hand via the grip recesses 34, and the fill chamber 24 may be filled with a liquid up to a desired amount. The end cap 48 may then be pulled off the lower end 46 of the fill tube 14, and the lower end 46 may be inserted into a tank or container to be filled. The valve 16 may then be opened so that the liquid drains from the fill chamber 24 through the fill tube 14 into the tank or container. The valve 16 may also be temporarily closed to fill additional tanks or containers with portions of the liquid.

The above-described funnel assembly 10 provides several advantages. For example, the fill tube 14 can be removably secured to the funnel 12 when the fill tube 14 is not fluidly connected to the funnel 12 via the lower opening 22. This allows the funnel assembly 10 to be unitarily and compactly stored and transported without the fill tube 14 being kinked or damaged. The funnel assembly 10 can also be stacked in an organized and consistent manner via the alignment structure 32.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A funnel assembly comprising:

a funnel having an outer wall defining a fill chamber with an upper opening for receiving a liquid;

a fill tube including opposing upper and lower ends, the upper end of the fill tube being configured to be fluidly connected to the funnel; and tube storage structure including:

an upper holder positioned near the upper opening; and left and right guides spaced below the upper holder, the left and right guides being vertically offset from each other, the tube storage structure being configured to removably secure the fill tube to the funnel when the upper end of the fill tube is not fluidly connected to the funnel so that the fill tube substantially conforms to the outer wall.

2. The funnel assembly of claim 1, the tube storage structure being positioned on an outside of the outer wall of the funnel.

3. The funnel assembly of claim 1, the upper holder being a protrusion configured to be inserted into the upper end of the fill tube.

4. The funnel assembly of claim 1, the outer wall having vertically convex curvature.

5. The funnel assembly of claim 1, the outer wall including structure configured to align with a fill tube attached to storage structure of another funnel assembly identical with the funnel assembly of claim 1 so that the funnel assembly of claim 1 is stackably aligned with the other funnel assembly.

6. A funnel assembly comprising:

a funnel having an outer wall defining a fill chamber with an upper opening for receiving a liquid;

a valve near a lower end of the outer wall and fluidly connected to the fill chamber;

a fill tube including opposing upper and lower ends, the upper end of the fill tube being configured to be fluidly connected to the funnel via the valve; and tube storage structure including:

an upper holder positioned near the upper opening; and left and right guides spaced below the upper holder, the left and right guides being vertically offset from each other, the tube storage structure being configured to removably secure the fill tube to the funnel when the upper end of the fill tube is not fluidly connected to the funnel so that the fill tube substantially conforms to the outer wall.

7. The funnel assembly of claim 6, the tube storage structure being positioned on an outside of the outer wall of the funnel.

8. The funnel assembly of claim 6, the upper holder being a protrusion configured to be inserted into the upper end of the fill tube.

9. The funnel assembly of claim 6, the outer wall having vertically convex curvature.

10. The funnel assembly of claim 6, the outer wall including structure configured to align with a fill tube attached to storage structure of another funnel assembly identical with the funnel assembly of claim 6 so that the funnel assembly of claim 6 is stackably aligned with the other funnel assembly.

11. A funnel assembly comprising:

a funnel having a convex, tapered outer wall defining a fill chamber with an upper opening for receiving liquid and including alignment structure;

a valve near a lower end of the outer wall and fluidly connected to the fill chamber;

a fill tube including opposing upper and lower ends, the upper end of the fill tube being configured to be fluidly connected to the funnel; and tube storage structure on an outer side of the outer wall, the tube storage structure including:

an upper holder positioned near the upper opening; and left and right guides spaced below the upper holder, the left and right guides being vertically offset from each other, the tube storage structure being configured to removably secure the fill tube to the funnel when the upper end of the fill tube is not fluidly connected to the funnel so that the fill tube substantially conforms to the convex, tapered outer wall, the alignment structure being configured to align with and accept a stored tube of another funnel assembly when the funnel assemblies are stacked together.

* * * * *